United States Patent [19]

Frankenbach

[11] Patent Number: 4,894,653

[45] Date of Patent: Jan. 16, 1990

[54] METHOD AND APPARATUS FOR GENERATING VIDEO SIGNALS

[75] Inventor: David C. Frankenbach, La Habra, Calif.

[73] Assignee: Hughes Aircraft Company, Los Angeles, Calif.

[21] Appl. No.: 211,492

[22] Filed: Jun. 24, 1988

[51] Int. Cl.[4] ..... G09G 1/28

[52] U.S. Cl. ..... 340/703; 340/799

[58] Field of Search ..... 358/22, 160, 21 R, 183; 340/703, 798, 799

[56] References Cited

U.S. PATENT DOCUMENTS

| | | | |
|---|---|---|---|
| 4,673,929 | 6/1987 | Nelson et al. | 340/744 |
| 4,704,605 | 11/1987 | Edelson | 340/728 |
| 4,724,431 | 2/1988 | Holtey et al. | 340/703 |
| 4,751,446 | 6/1988 | Pineda et al. | 358/89 |
| 4,769,632 | 9/1989 | Work et al. | 340/703 |
| 4,800,380 | 1/1989 | Lowenthal et al. | 340/703 |
| 4,803,464 | 2/1989 | Holmes et al. | 340/703 |
| 4,827,255 | 5/1989 | Ishii | 340/703 |

*Primary Examiner*—John W. Shepperd
*Assistant Examiner*—Michael D. Parker
*Attorney, Agent, or Firm*—William C. Daubenspeck; Wanda K. Denson-Low

[57] ABSTRACT

A video signal generator employs a host subsystem (11), display controller system (18), display generator subsystem (20), refresh memory subsystem (24), and video data system (28) to process pixel data in parallel to achieve high pixel frequency rates permitting large flicker-free images. To achieve high pixel frequencies, parallel processing is maintained from the bit map memory (36) until the data is processed by the digital-to-analog converter (DAC) (54). The display generator subsytem (20) outputs a multi-bit digital data address signal (35) which is used to address a plurality of bit map memory (BMM) arrays (36). The BMM arrays (36) operate in parallel, and the data (35) is read into a portion of each BMM array (37, 39) until the array (37, 39) is filled. The data is read out of the arrays (37, 39) in parallel (32) and into a plurality of BMM output multiplexers (MOM) (38), new data continuously being read into each BMM array (37, 39). The MOM (38) time division multiplexes the data signal (32) into data nibbles (26), of fewer bits, representing the color intensity of the data signals (32). The data nibbles (26) are multiplexed by a plurality of video multiplexers (40) to produce a multi-bit color intensity code )44) which is used to address a plurality of color look-up tables (CLUTs) (40). The CLUTs (40) select the array data for display, and generate color codes (48). The color codes (48) are multiplexed to the desired pixel frequency rate and are input into DACs (54) to drive a monitor (58).

4 Claims, 3 Drawing Sheets

DISPLAY PROCESS 186/286
12
BULK MEMORY
14
GRAPHIC PROCESSOR
16
11
SYNC.
15
CURSOR LOGIC
17
VIEWPOINT LOGIC
19
18
60
SYMBOL COGEN
21
VEC/CON COGEN
23
MTU
25
AREA FILL
27
20
22
MEMORY CONTROL
34
35
BIT MAP MEMORY
36
32
MEMORY OUTPUT MUX
38
24
26
27

METHOD AND APPARATUS FOR GENERATING VIDEO SIGNALS

TECHNICAL FIELD

The present invention broadly relates to image generation systems employing video signals, and more particularly, to video signal output systems for generating high-speed flicker-free raster graphic images. The video signal output system of the present invention improves the achievable pixel frequency rate of raster graphics processing equipment and therefore is particularly adapted for use in raster image generator systems where high pixel frequency rates are desirable.

BACKGROUND ART

Most image display applications employing video signals require flicker-free display of large images, particularly those for air defense and air traffic control. More generally, high performance CAD (computer-aided design) systems demand greater processing speeds. Currently, the objectives for many of these applications are formalized as flicker-free images of 2048 by 2048 picture elements ("pixels").

Examples of existing raster graphics systems are Hughes Aircraft Company's HMD-8000, HDP-4000, and CDITEG, Motorola's 8250 and Ramtek's 9465. Most existing state of the art systems are targeted at supporting 1280 by 1024 displays with a 60 Hz, non-interlaced, refresh rate. To provide such a display requires a pixel rate of about 110 MHz.

Such systems generally include an array of bit map memories (BMM), each of which includes a representation of an image which can be sent to a monitor to be displayed. Each resolvable point or pixel of the monitor is mapped to an address in each BMM, and each such address contains a digitally encoded representation of the color and intensity to be displayed at the corresponding pixel. A video multiplexer is used to select which of the BMMs determines the display at any given time. A color look-up table translates the selected raster data stream into the proper color codes for use by the display monitor.

In the above-mentioned raster graphics systems the output of the BMM array is immediately converted to a serial bit data stream at the pixel rate. All further processing including video multiplexing and color look-up is then performed at the pixel rate. This approach limits the achievable pixel rate to a little more than 100 MHz due to device speed limitations.

To achieve raster display systems capable of supporting flicker free refresh of displays with up to 2048 by 2048 resolution requires pixel rates as high as 400 MHz. Such speeds exceed the performance limitations of available processing devices such as video multiplexers and color look-up tables. Even as technological progress provides faster electronic devices, applications demands are expected to outstrip such improvements in the foreseeable future.

Thus, there is a need in the art for a new system architecture to take advantage of the capabilities of present and future devices to permit large flicker-free images. In particular, such an architecture is needed to provide effective pixel rates as high as 400 MHz using available devices.

SUMMARY OF THE INVENTION

In accordance with the present invention, higher speed flicker-free images are provided by maintaining parallel digital pixel processing through the output of the look-up table, and only at a final output stage converting to an analog serial bit stream. The effective pixel rate is then approximately the number of parallel channels times the rate permitted by the individual devices.

In a preferred embodiment, a four-pixel wide data path is maintained from the BMM array output until the data is processed by digital-to-analog converters (DAC). The output of each BMM plane is converted to a four-pixel wide path running at $\frac{1}{4}$ of the pixel display rate. From this point, the data from each BMM plane is sent to a video multiplexer via a video bus. Color look-up tables are programmed by a host processor to select the appropriate color codes for display. Data is input to each of four color look-up tables respectively associated with the four pixels of data being processed in parallel. Color codes are read as digital data from the four color look-up tables, and the color code data is then multiplexed up to the pixel rate and fed into the inputs of the DAC to drive a display device such as a CRT monitor.

By processing four pixels in parallel, pixel rates as high as 400 MHz can be achieved. This permits a flicker-free 2048 by 2048 pixel color display. With greater parallelism, greater dimensions can be accommodated.

DESCRIPTION OF THE PREFERRED EMBODIMENTS

Figures 1, 1A, 1B:
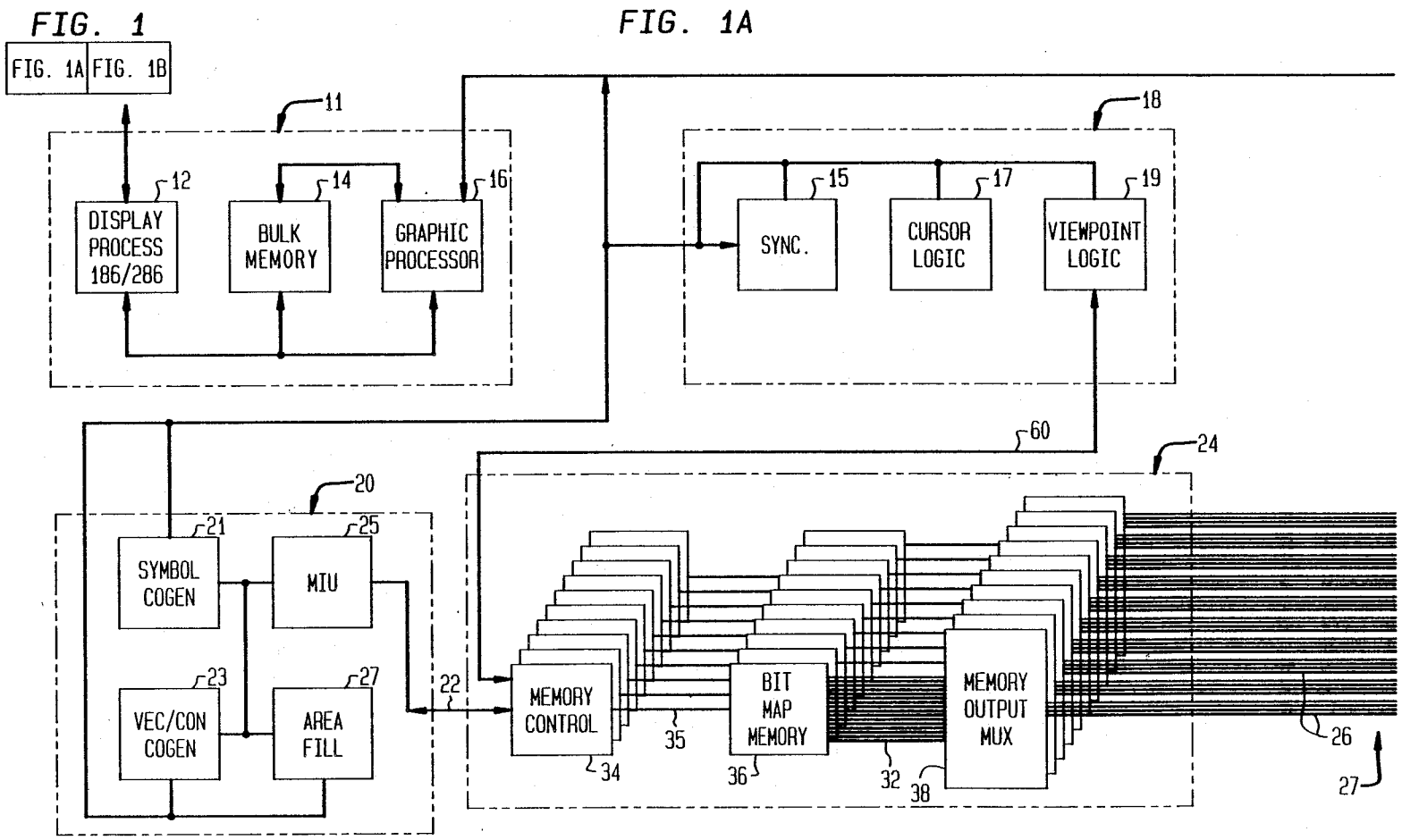
FIGS. 1, 1A and 1B, taken together, form a block diagram of the apparatus for generating video signals which forms the preferred embodiment of the present invention.
Figure 1B:
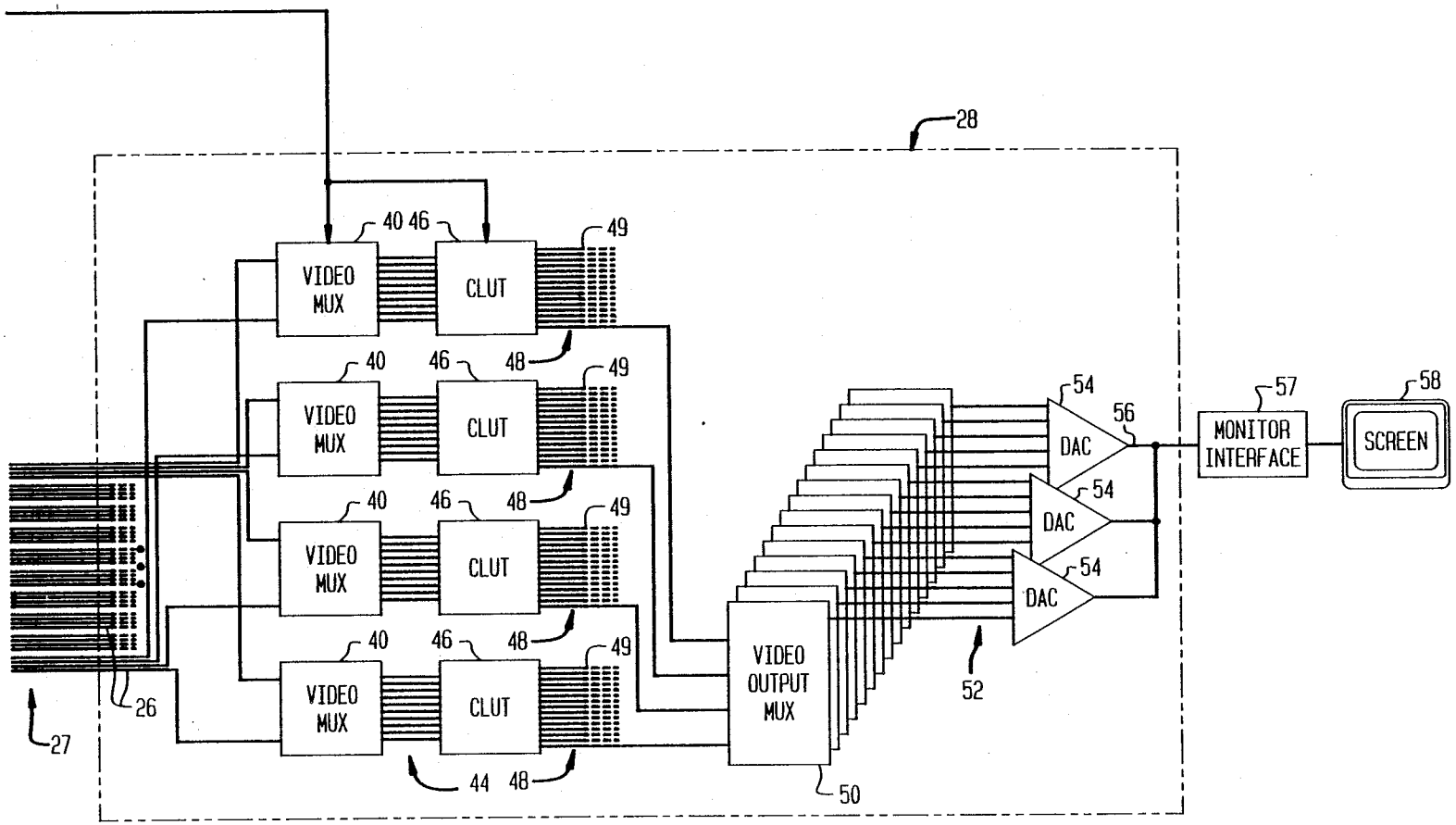

Referring to FIG. 1, an apparatus for generating video signals is illustrated, which may be employed to provide a raster image display for a graphics console or the like. The video signal generator employs a conventional host processor subsystem 11 which includes a display processor 12, a bulk memory 14, a graphics processor 16, all of which are conventional and well known in the art. The video signal generator also utilizes a standard display controller system 18 typically consisting of a standard synchronization module 15 which generates video synchronization signals in response to timing signals, a conventional cursor logic controller 17 and a standard viewport logic controller 19. The video signal generator also includes a display generator subsystem 20 which includes a symbol cogenerator 21, a conventional vector/conic cogenerator 23, a standard memory interface unit (MIU) 25, and a conventional area-fill cogenerator 27.

The display generator subsystem 20 generates image data to be displayed on the screen 58 and outputs onto the image bus 22, a standard data/address/command bus structure, including a sixty-four bit signal containing address information of the locations in the bit map memories 36 that the image data is to be written into and also containing color information pertaining to the data to be displayed. The image bus 22, which reads or writes in one bus cycle, a sixty four bit word interfaces the display generator subsystem 20 with the refresh memory subsystem 24. The refresh memory subsystem 24 is comprised of a plurality of standard bit map memory (BMM) control arrays 34, a plurality of bit map memory arrays 36, and a plurality of bit map memory output multiplexers 38. The memory controls' 34 main function is to interface the refresh memory subsystem 24 with the image bus 22 and the video refresh address bus 32. In addition, the memory controls 34 perform all of the read, write, clear, and data transfer operations based upon the commands it receives from the image buses 22 and the video refresh bus 32.

The memory controls 34 receive from the image bus 22 the addresses of the BMM arrays 36 where the image data is to be mapped. The memory controls 34 transmits an address signal 35, defining the bit map memory array 36 to be addressed and the pixel to be addressed, to the bit map memory arrays 36. The bit map memory arrays 36 addresses correspond to addresses of the pixels on the monitor screen 58. The address signal 35 received is in the format of a 1×16 block of pixels along one horizontal raster line or a 4×4 block of pixels. In the illustrated embodiment, there are ten BMM arrays 36 arranged and operated in parallel with each other. The arrays 36 are also referred to as bit map memory planes. The number of memory planes 36 employed in a raster graphics system is dependent upon the color intensity desired. With ten memory planes 36, each pixel ultimately has ten bits defining its color intensity where one bit is associated with each memory plane 36.

Figure 2:
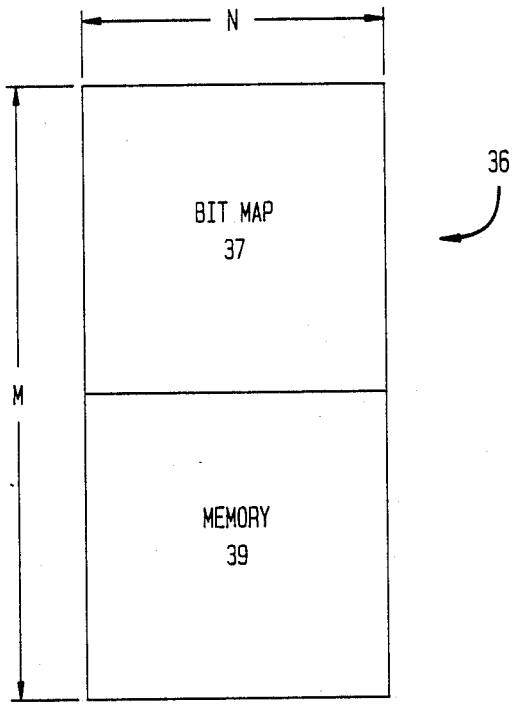
FIG. 2 is a diagrammatic view of an N×M bit bit map memory array employed in the apparatus of FIG. 1.

Referring now also to FIG. 2, each of the bit map memory arrays 36 is a N×M array. Since a typical monitor screen 58 requires 2K×2K of memory, each bit map memory array 36 has enough storage space to store two screens worth of data. Hence, each of the arrays 36 may be defined as one memory plane of 2K×4K or two pseudo planes 37, 39 each having a size of up to 2K×2K of storage locations. Initially, the bit map memory address signal 35 carrying image data, is read line by line into the lower plane 39 and once the array 39 is filled, the image data is ready to be displayed on the screen 58. The array 39 is toggled so that the array data 32, in digital form, is read out of the lower array 39 sixteen bits in parallel 32. Since one bit represents one pixel, the sixteen bits respectively represent sixteen pixels along one raster line. Data is read out of the array 36 sixteen pixels at a time from each memory plane. While the data is being read out of array 39, the next screen is being formed in the upper plane 37. When the plane 37 is formed, the data stored in the array 37 is read out sixteen pixels in parallel on parallel lines 32, while new image data is being formed simultaneously in the lower plane 39 such that the image form/display process flips up back and forth between images being formed in the upper plane 37 and the lower plane 39.

The ten, sixteen bit array data words 32 are input to the bit map memory output multiplexers (MOM) 38 which interface the bit map memory arrays 36 with the video bus 27. Ten MOM's 38 are provided since there is one MOM 38 associated with each memory plane 36. The MOM 38 receives the sixteen parallel bit array data word 32 operating at TTL level, and time division multiplexes, in four consecutive clockings, each group of sixteen bits 32 into four consecutive four-bit nibbles 26 operating at ECL level. At each clocking, the MOM 38 outputs four bits in parallel, where the four parallel bits define the four-bit nibbles 26. Each four-bit nibble 26 represents the color intensity of four of the sixteen pixels, one bit representing one pixel, and each four-bit nibble 26 represents four of the sixteen pixels. The nibbles 26 operate at one-fourth of the final pixel frequency rate because instead of processing one sixteen serial bit word output from the bit map memory array, a nibble of one-fourth the length is processed in one-fourth the time.

After four consecutive clockings, a new sixteen bit array data word 32 is read out of the bit map memory array 36 and is multiplexed by the MOM 38. Since there are ten MOMs 38, one for each memory plane 36, a total of ten four-bit signals are output from the MOM 38 simultaneously, during one clocking, and carried over the video bus 27.

The video bus 27 interfaces the MOM's 38 with the video data system 28. The video data system 28 is comprised of conventional video multiplexers (video MUX) 40, conventional color look-up tables (CLUT) 46, video output multiplexers (VOM) 50, and conventional digital to analog converters (DAC) 52. For each pixel that is processed in parallel, there is one video MUX 40. Since the illustrative embodiment processes four pixels in parallel, at any given time, there are four video MUX's 40. The video MUX's 40 are arranged and operated in parallel.

Each of the four bits in the four-bit nibble 26 serves as an input into one of the four video MUX's 40 such that each video MUX 40 receives one bit of data that was output from each of the MOM's 38. But video MUX 40 is capable of receiving input from up to twenty memory planes and it is capable of outputting data for ten memory planes. Hence, the function of the video MUX 40 is to select which data input is to be output.

The video MUX 40 receives commands from the display processor 12, instructing it on which of the ten bit map memory planes 36 will be displayed. The video MUX 40 outputs a ten parallel bit color intensity code 44, wherein the number of bits in the color code is dependent upon the number of memory planes that will be displayed. Since the illustrated system displays data from ten memory planes 36, the color intensity code 44 is a ten-bit code. The ten-bit color intensity code 44 defines the color of a pixel because each of the ten bits represent the color intensity of one pixel on all ten planes 36.

There is one CLUT 46 for each video MUX 40 and since the system only employs ten memory planes 36, there is a one for one mapping between the video MUX 40 and the CLUT 46. The CLUT 46 provides color information about the pixel location to be displayed on the screen 58. Each CLUT 46 is 1K×16K and the CLUT 46 operates simultaneously in parallel, each table operating on one pixel of data. At each address location in the CLUT 46 a fifteen-bit color word is stored. The CLUT 46 outputs the fifteen-bit color word, fifteen-bits in parallel 48 and the color word 48 is input into the video output MUX (VOM) 50. There are fifteen VOM's 50, there being one VOM 50 corresponding to each bit in the fifteen bit color word 48. The VOMs 50 operate in parallel and each VOM 50 receives one color bit from each of the four fifteen-bit color words 48. Hence, each VOM 50 receives as input a total of four parallel bits 49. The VOM 50 functions to perform a four-to-one time division multiplexing on the four-bit input word 49 and outputs one one-bit word, at its final pixel frequency of approximately 400 MHz. The fifteen one-bit output 52 from the fifteen video output MUX's 50 forms the final color intensity word for one pixel on the monitor screen 58.

The VOM 50 has an internal clock and in order to process the original sixteen-bit word 32 four successive clockings are required. At each clocking, the fifteen VOMS 50 which output one bit, cumulatively generate a new fifteen-bit color intensity word, representing the color of one particular pixel.

The final color intensity word 52 is further arranged into three five-bit words, each five-bit word being designated for each of the three digital to analog converters 54: a red DAC, a green DAC, and a blue DAC. The digital to analog convertors 54 convert the fifteen-bit digital color intensity code 52 into a red, green, blue, analog signal 56. The analog signal 56 enters a conventional monitor interface 57 which coordinates and synchronizes the signal 57 so that it can be displayed on the monitor screen 58.

The display monitor screen 58 is updated at periodic intervals every time the refresh controller 16 issues a refresh signal 60. The viewport logic 19 which is under the control of the sync generator generates the display refresh addresses and signals 60. The display refresh addresses and signals 60 are sent to the memory controls 34 which perform the BMM read cycles. When a refresh signal is received, a new set of sixteen pixels, in the bit map memory array 36, is read out and processed in parallel through the output of the color look-up tables 46 and only at the final output stage of the VOMS 50 will the parallel processing cease and the signals converted to an analog serial bit stream at the final pixel frequency rate.

What is claimed:

1. In an apparatus for generation color video signals of the type employing a refresh memory subsystem and a video data subsystem for providing an analog serial bit stream for a display device, the improvement being means for increasing the pixel frequency rate of the analog serial bit stream comprising:

(a) a plurality of bit map memory arrays, the number of bit map memory arrays related to the number of variations of color intensity for each pixel at said display device, each said bit map memory array providing an X-bit parallel data word at a first clock frequency;

(b) a video bus;

(c) a plurality of memory output multiplexers, one of said plurality of memory output multiplexers coupled to receive the X-bit parallel data word at the first clock frequency from a corresponding one of said plurality of bit map memory arrays, each of said memory output multiplexers operating to time-division multiplex each X-bit parallel data word into Y consecutive data words having X/Y parallel bits, said Y consecutive X/Y-bit parallel data words being coupled to said video bus;

(d) X/Y video multiplexers, each of said video multiplexers coupled to said video bus for receiving one of the X/Y bits from each of said X/Y-bit parallel data words at the first clock frequency, the output of said X/Y video multiplexers being a parallel-bit data word containing a color intensity code related to the number of bit map memory arrays;

(e) X/Y color look-up tables, one of said color look-up tables being coupled to one of said X/Y video multiplexers for receiving the color intensity code from said video multiplexers, said color look-up tables providing a multiple-bit color word in response to said color intensity code;

(f) a plurality of video output multiplexers coupled to receive the multiple-bit color word from the color look-up tables, said video output multiplexers performing time-division multiplexing on the multiple-bit color word to provide a plurality of one-bit output words at a final pixel frequency that is X/Y times the first clock frequency; and (g) digital to analog converter means for converting the plurality of one bit data words to an analog signal.

2. The apparatus as recited in claim 1 wherein said plurality of memory output multiplexers operate to time-division multiplex each X-bit word into 4 consecutive data words having X/4 parallel bits.

3. The apparatus as recited in claim 1 wherein each of said plurality of bit map memory arrays comprises an array having storage space sufficient to store two screens of data, each of said plurality of bit map memory arrays having a first plane and a second plane, and wherein data is read into the first plane from a memory control means at the same time data is being coupled from the second plane to one of said memory output multiplexers.

4. The apparatus as recited in claim 1 wherein the memory output multiplexers further receive said X-bit parallel data word at the TTL level and output said Y consecutive X/Y-bit parallel data words at the ECL level.

* * * * *